US006021866A

United States Patent [19]

Meeks

[11] Patent Number: 6,021,866

[45] Date of Patent: Feb. 8, 2000

[54] COLLAPSIBLE SAWHORSE TRESTLE AND LEG STRUT

[76] Inventor: Millard Meeks, 265 Meadow Rd., Chester, Calif. 96020

[21] Appl. No.: 08/821,902

[22] Filed: Mar. 21, 1997

[51] Int. Cl.[7] ..... B27B 21/00

[52] U.S. Cl. ..... 182/153; 182/225

[58] Field of Search ..... 182/153, 225, 182/181.1, 25

[56] References Cited

U.S. PATENT DOCUMENTS

| | | | |
|---|---|---|---|
| 145,174 | 12/1873 | Harden . | |
| 249,095 | 11/1881 | Reyburn | 182/153 |
| 437,936 | 10/1890 | O'Brien | 186/24 |
| 2,230,019 | 1/1941 | Rich | 186/176 |
| 4,429,765 | 2/1984 | Garcia | 182/153 |
| 4,756,385 | 7/1988 | Deitz | 182/153 |
| 5,351,785 | 10/1994 | DuRapau . | |

FOREIGN PATENT DOCUMENTS

| | | | |
|---|---|---|---|
| 42453 | 6/1910 | Australia | 182/153 |

*Primary Examiner*—Alvin Chin-Shue
*Attorney, Agent, or Firm*—Joseph E. Gerber

[57] ABSTRACT

Disclosed herein is a trestle-type, dual-frame sawhorse including first and second generally rectangular, identical frame members, hinged together along their horizontal top beams, each having depending legs with horizontal leg braces parallel to the top beams. Each leg has a longitudinal slot with a transverse pin which passes through a bound space defined within a rigid, rectangular-framed strut. Each strut has a pair of longer side members and a pair of shorter side members, and is bound by the pins into the slots of both legs of a leg pair. The strut can be moved to a vertical position whereby the legs of the sawhorse are held together, or the strut can be allowed to drop into a horizontal position where it keeps the legs from splaying farther when the sawhorse is under load. Detent notches in the inner surfaces of the strut permit the sawhorse to resist being collapsed back into its folded orientation. An alternative embodiment of the sawhorse includes an additional, generally vertically-oriented structural member integral to each frame member of the sawhorse, having an upper end fixed to the underside of the horizontal top beam and a lower end fixed to the horizontal leg brace. Each vertically-oriented structural member includes a slot with a transverse pin. Thus, a pair may have a single strut bound between them to permit the frames with which they are associated to be fixed securely in either an open or closed orientation.

15 Claims, 8 Drawing Sheets

FIG. – 1
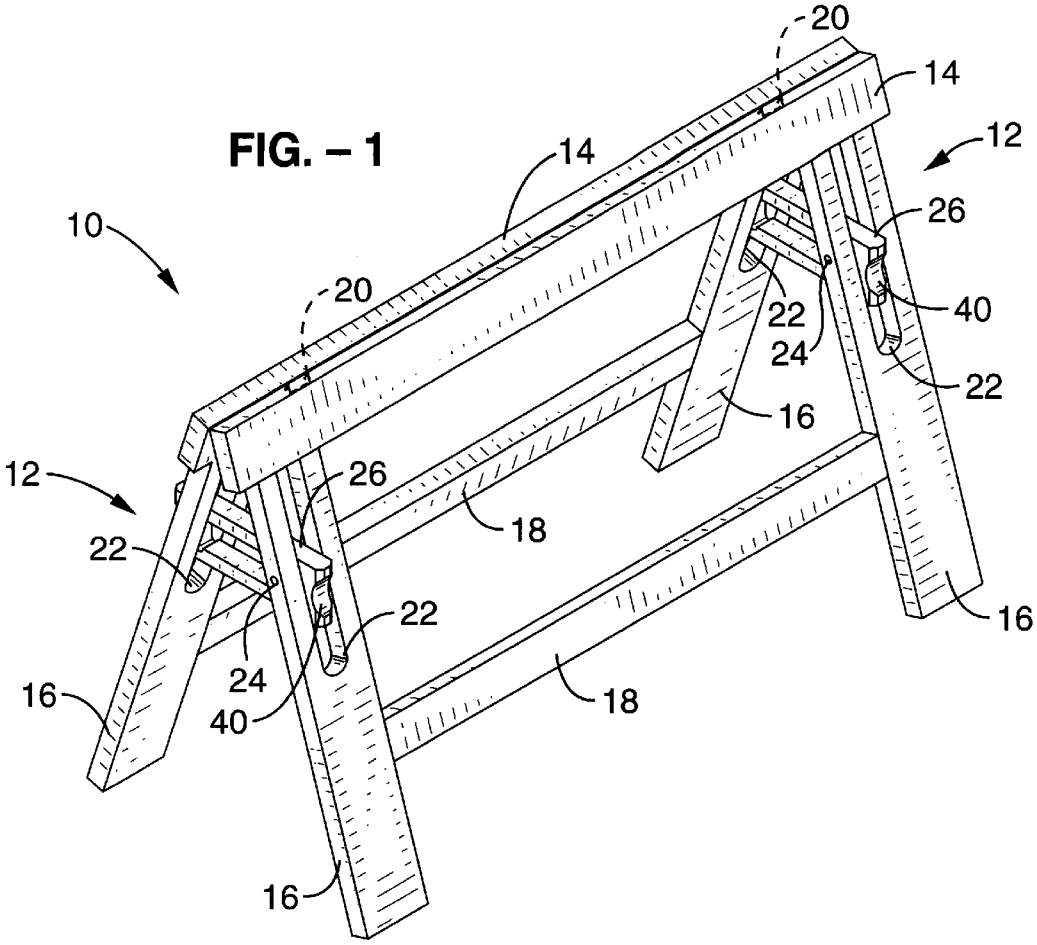
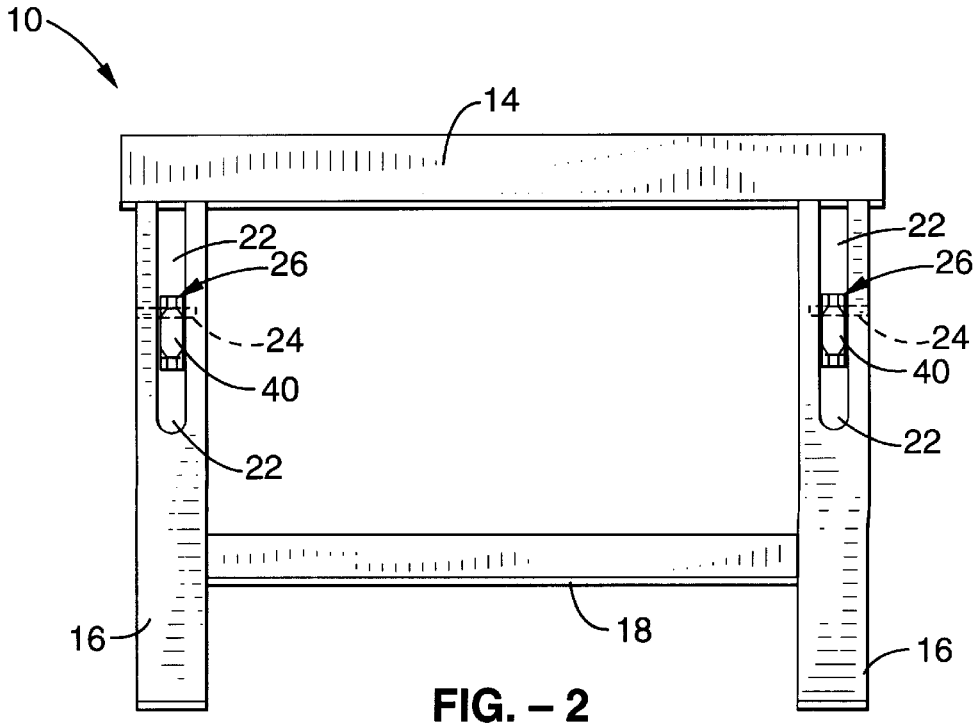
FIG. – 2

COLLAPSIBLE SAWHORSE TRESTLE AND LEG STRUT

BACKGROUND OF THE INVENTION

1. Field of the Invention

The present invention relates generally to trestle constructions and similar structural support apparatus, and more specifically to sawhorses for supporting work surfaces and workpieces, and to leg and cross-brace constructions for these and related supporting structures.

2. Description of the Related Art

Sawhorses traditionally used in the trades and in the home workshop have typically been of simple construction including a horizontal supporting beam with a pair of legs at either end. The legs are commonly secured to the beam at their upper ends, and diverge outward as they project downward from the beam. Horizontal reinforcing elements perpendicular to the plane of the beam, such as braces tying each leg of a pair to the other, are common. Horizontal braces may also run parallel to the beam, tying legs of opposing pairs on the same side of the beam together. In their simplest form, such horizontal braces comprise lengths or panels of wood or metal fastened to the sawhorse's legs with nails or screws. However, when a sawhorse is constructed with permanently-affixed leg braces, it is a rigid structure that is awkward to lift and move, and difficult to store without wasting space.

Storage efficiency and portability are improved in several sawhorse kit-type constructions that permit disassembly of the legs from the beam. One such sawhorse kit comprises a hinged clamp with integral, parallel-projecting legs, wherein the toothed jaws of the clamp are adapted to grip a wooden beam when the legs are splayed outward. One pair of such beam-gripping legs clamped to each end of a two-by-four beam yields the familiar, sturdy, trestle-shaped sawhorse construction. Clamp-on legs of this type can be disengaged from the beam by bringing the legs back into parallel alignment, thus releasing the clamp's jaws from the beam.

While the beam-gripping mechanism of the afore-described kit includes legs integral with the hinged clamp, the legs of of other beam-gripping clamp kits are removable. That is, instead of including integral legs, these kits include means for gripping and releasing the individual legs, as well as means for gripping the beam. Thus, when completely disengaged from the legs and the beam, this clamp type permits the sawhorse to be completely broken down into its basic components—four separate legs, two gripping hinges and the beam—for very easy storage.

Despite being technically disassemblable and reassemblable, however, as a practical matter, such kits tend to be difficult to use. One problem is that it can take great deal of force to drive the teeth of such a clamp into the wood of the intended beam; and, keeping the legs at the correct angle to the beam during that process is a challenge. Further, sawhorses constructed from such kits often need additional reinforcement, and the easiest manner of providing that is by addition of the same type of permanent horizontal braces employed on non-collapsible sawhorses, thus eliminating one of the major benefits of such kits.

One type of leg brace that permits a pair of hinged sawhorse legs to be folded into a more storable, portable, parallel orientation is a horizontal strut having a hinged, mid-length joint, wherein each end of the strut has a pivoting connection bound to one of the two legs. Some means for locking the mid-length joint is essential; an over-center locking construction is preferred for ease of use. As the mid-length joint is forced into its over-center position, the legs tied thereto become resistant to splaying farther, and they also become resistant to being collapsed toward each other into their parallel-aligned storage orientation. Such a hinged, locking strut is employed as a brace in kits of the type described above having legs integral with the hinged beam clamp, and in that environment it serves the helpful purpose of keeping the clamp's teeth firmly embedded in the wood of the beam. However, releasing the strut's over-center joint to collapse the legs for storage also loosens the clamp's grip on the beam, thus causing difficulty in the next set-up cycle.

An alternative, partially-collapsible sawhorse construction that potentially has much greater strength and avoids the problems of hinged clamps is comprised of a pair of identical, generally rectangular frame members, wherein the horizontal top portions of the frame members are parallel and hinged to one another. Thus, sawhorses of this construction have a double top beam. Such dual-frame sawhorses are able to be folded into a relatively thin planar configuration for storage. And, although, dual-frame sawhorses may not be as completely collapsible as the clamp-on leg-type sawhorses discussed above, the trade-off in strength and stability is usually worth it. An example of a sawhorse of dual-frame construction is shown in U.S. Pat. No. 5,351,785 issued to DuRapau et al. in 1994. Supplemental horizontal braces parallel to the top beam are not necessary in such a sawhorse because they are an integral portion of each of the identical frame members. But, some kind of horizontal braces transverse to the top beam are essential to keep the two frame members from splaying out too far, or from folding together into the sawhorse's stowing position. Over-center locking struts and other types of ties, straps and brackets have all been used to tie the halves of dual-framed sawhorses together; some, as that in DuRapau et al., include a folding tray as a brace. But, these can be cumbersome to use in that they require hand manipulation of pins, hinges, nuts and bolts, or various other fasteners to set up, and then to fold up, the sawhorse. Further, many have struts, braces or other elements that only permit the sawhorse to be unfolded and assembled from one side. This can be a significant inconvenience when working in tight quarters, or when a user has only one hand free.

Thus, it appears that a need exists for a strong, stable sawhorse design that can be at least partially collapsed. And, it should be easy to use, and to set up and to break down. Further, a need exists for an easy-to-use leg brace or strut for holding splayed legs of sawhorses and other such supporting structures at a fixed distance from one another. Such a brace or strut should be able to be engaged and disengaged easily, but should give strong support and resistance to disengagement when under load.

SUMMARY OF THE INVENTION

The sawhorse of the present invention is adapted to overcome the above-noted shortcomings and to fulfill the stated needs. The present invention also includes a novel construction for a brace or strut for sawhorses and other upstanding supporting structures.

The inventive sawhorse is of a trestle-type construction and comprises first and second generally rectangular frame members which are virtually identical, each frame member including an upper, horizontal support beam, and each being hingedly connected to each other at the support beam. Each frame member also includes a slot in one of its structural members, each such slot having a transverse pin therethrough. And, means for selectively fixing the frame members at a first maximum distance from each other or, alternatively, at a second maximum distance from each other, are engaged with both slots. Further, means are provided for causing the frame members to resist returning toward each other from the greater of the two maximum distances.

The leg distance fixing means is separately inventive and comprises a rigid, rectangular-framed strut slidingly engaged with both slots and bound therein by the pins, thus tying the frame members together. The strut comprises two longer side members and two shorter end members. The strut's side members are shorter than the slots, thus permitting it to slide through each slot in any orientation.

It is an object of the present invention to provide a collapsible sawhorse trestle which is strong, stable and easy to use.

It is a further object of the present invention to provide a strut for a sawhorse or other supporting structure which is able to be engaged and disengaged easily, but should give strong support and resistance to disengagement when under load.

Still further objects of the inventive structures disclosed herein will be apparent from the drawings and following detailed description thereof.

BRIEF DESCRIPTION OF THE DRAWINGS

FIG. 1 is a perspective view of the sawhorse of the invention.

FIG. 2 is a side elevation view of the sawhorse shown in FIG. 1.

DESCRIPTION OF THE PREFERRED EMBODIMENT

Figure 3:
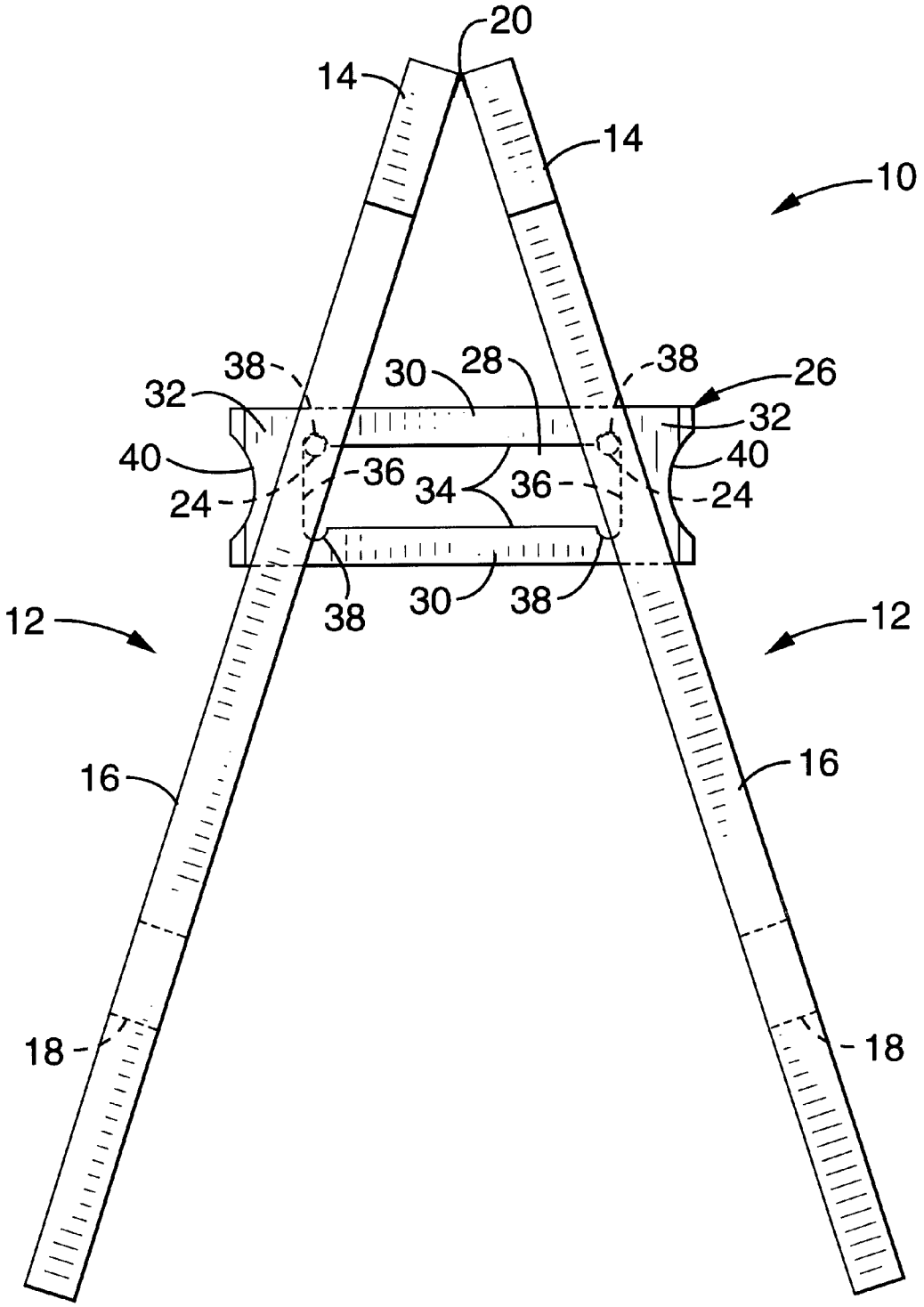
FIG. 3 is an end elevation view of the sawhorse shown in FIG. 1.

Referring now specifically to the drawings, FIGS. 1 through 5 show the inventive, collapsible, trestle-type sawhorse, which is generally identified herein with the reference numeral 10. Sawhorse 10 is of a dual-frame construction, i.e. it is comprised of a pair of identical, generally rectangular frame members. Each frame member 12 is comprised of horizontal top beam 14; an identical leg 16 affixed to and depending vertically from each end of horizontal top beam 14; and, horizontal brace 18 between the lower ends of legs 16. Each frame member 12 is generally planar and is preferably an integral structure unto itself. Wood with securely-glued, doweled joints is preferred, but metal and other materials and constructions may also prove satisfactory.

Hinges 20 bind top beams 14 of a pair of these frame members 12 together in forming the dual-frame sawhorse 10 of the invention. One leaf of each hinge 20 is bound to each frame member 12's top beam 14 such that when frame members 12 are drawn apart, the lower portions thereof diverge while the upper portions thereof remain affixed to one another.

An upper portion of each leg 16, just below top beam 14, includes longitudinal slot 22. Each slot 22's long axis is transverse to top beam 14's axis. Planes passing through the slots 22 of each opposed pair of legs 16, one pair being at each end of sawhorse 10, are also transverse to top beam 14's axis. The length of each slot 22 is, roughly, about one-third to one-half the length of its respective leg 16. Each slot 22 preferably has the same length and width as all other slots 22.

Figure 5:
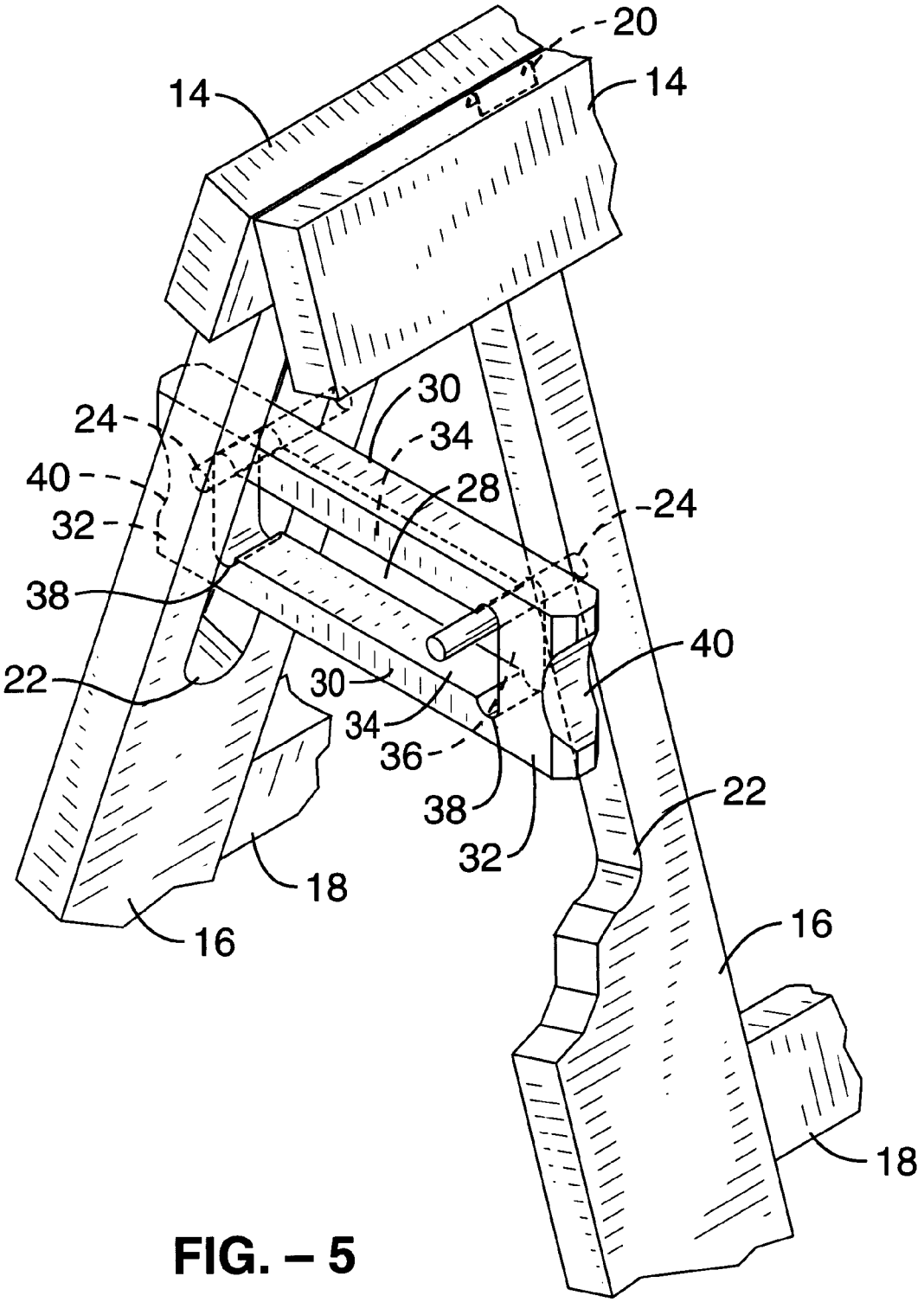
FIG. 5 is a partially fragmentary enlarged perspective of the engagement of a strut with the slots and transverse pins of the sawhorse shown in FIG. 1.

Each slot 22 is spanned by a transverse pin 24. Pins 24 are parallel to top beam 14's axis, and each is positioned about half-way up its respective slot 22. Each pin 24 is placed across its respective slot 22 by drilling through the side of leg 16 and across slot 22, as shown in FIGS. 2 and 5. Then, pin 22 is driven into the hole and cut off flush with leg 16's outer surface. Pins 24 are preferably cylindrical wooden dowels all of the same diameter, but other constructions may prove satisfactory.

Figure 4:
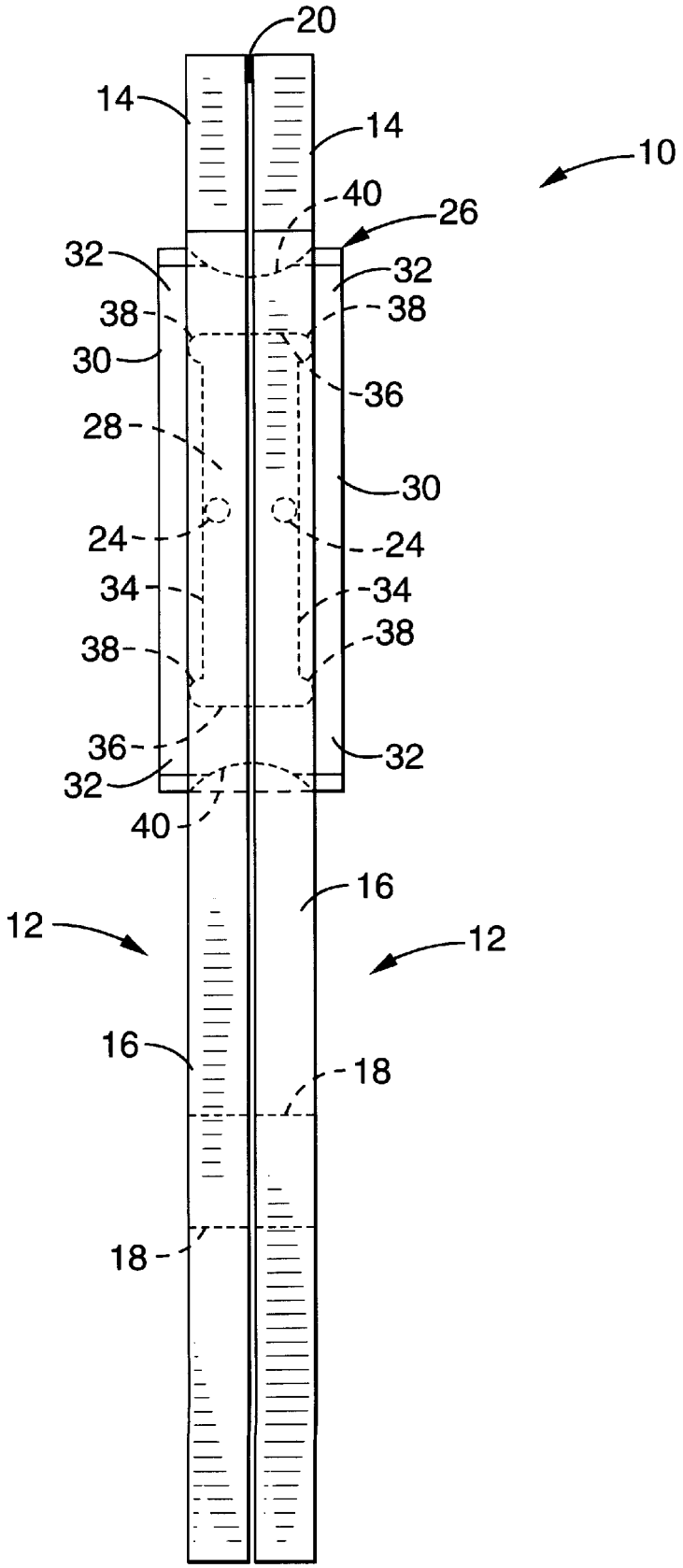
FIG. 4 is an end elevation view of the sawhorse of FIG. 1, wherein the sawhorse is folded into its storage position.

Each opposed pair of legs 16, one pair being at each end of sawhorse 10, is tied together by a moveable, multi-positionable strut 26. Strut 26 is a rigid, generally rectangular-framed structure, comprising a closed loop and defining a bound space 28 therewithin. Strut 26 is best shown in FIGS. 3, 4 and 5. Strut 26 comprises two longer side members 30 and two shorter end members 32. Strut 26's side members 30 and end members 32 should be narrower throughout than the width of each slot 22. Further, strut 26's side members 30 must be slightly shorter than slots 22. These size restrictions on strut 26 with respect to slot 22 permit strut 26 to slide freely through each slot 22 in any orientation.

Each strut 26 is also preferably not more than a bit wider across its width, i.e. between the outer surfaces of its side members 30, than the thickness of both frame members folded against each other as in FIG. 4. This prevents strut 26 from projecting obtrusively when nested upright in slots 22, and making sawhorses 10 more difficult to store.

Each strut 26 is bound to both legs 16 of the leg pair with which it is associated by pins 22 which pass through bound space 28 within, i.e. defined by, strut 26's frame. For each leg pair at each end of sawhorse 10, strut 26 remains slidingly engaged with both slots 22 of both opposed legs 16 at all times, because strut 26 is inextricably bound into slots 22 by pins 24 during sawhorse 10's construction. That is, after slots 22 are cut in legs 16, and after the holes are drilled through legs 16 and across slots 22 for receipt of dowel pins 24, strut 26 is slid part-way into each slot 22, and then each pin 24 is permanently driven into its hole and glued into place across slot 22, locking strut 26 to both legs 16 of an opposing pair. Once assembled, each movable strut 26 is able to be rotated freely through a full 360 degrees in a generally vertical plane when legs 16 of the leg pair to which strut 26 is bound are close together and generally parallel as when sawhorse 10 is in its fully folded, storage position. That fully-folded position is shown in FIG. 4.

A strut 26 comprised of wood subunits securely doweled and glued together has been found satisfactory in practicing the invention, but other materials and constructions may also prove sufficient.

In the drawing figures, the inner surface of each side member 30 is identified with reference numeral 34, and the inner surface of each end member 32 is identified with reference numeral 36. The inner surfaces 34 and 36 of strut 26's side members 30 and end members 32, respectively, are substantially planar. However, a detent notch 38 is preferably provided at each right-angled intersection where each side member 30's inner surface 34 meets each end member 32's inner surface 36. Thus, four detent notches 38 are preferred; and, all should be the same size. Each detent notch 38 should be shaped as a portion of a circular arc. The axis of the arc of each detent notch 38 should lie in the plane of its respective side member 30's inner surface 34; and, the axis of each detent notch 38's arc should also be perpendicular to the length of its respective side member 30. Further, each detent notch 38 should be placed precisely so that an inner surface 36 of an end member 32 meets notch 38 at a tangent to its arc. Thus, as can best be seen in FIGS. 3, 4 and 5, each detent notch is preferably actually a notch in a side member 30's inner surface 34, and not in an end member 32's inner surface 36. That is, the axes of the arcs of notches 38 do not lie in the planes of the end member 32's inner surfaces 36. Each detent notch 38 should have a diameter slightly larger than the diameters of pins 24.

Concave faces 40 are provided on the outer surfaces of end members 32. Each concave face 40 preferably describes a portion of circular arc, and the arcs of the concave faces 40 at both ends of strut 26 should be the same. Concave faces 40 tend to cause struts 26 to come spontaneously to rest in an upright position, parallel to legs 16, when sawhorse 10 is folded up into its storage position such that legs 16 of a pair and their respective slots 22 are closely adjacent to one another, as in FIG. 4.

Those portions of the outer faces of end members 32 that flank concave faces 40 may be beveled, as shown in the drawings. Such beveling of these and other hard corners throughout the structure of sawhorse 10 is expected to permit the interacting elements of the apparatus to work together more smoothly.

Figure 6:
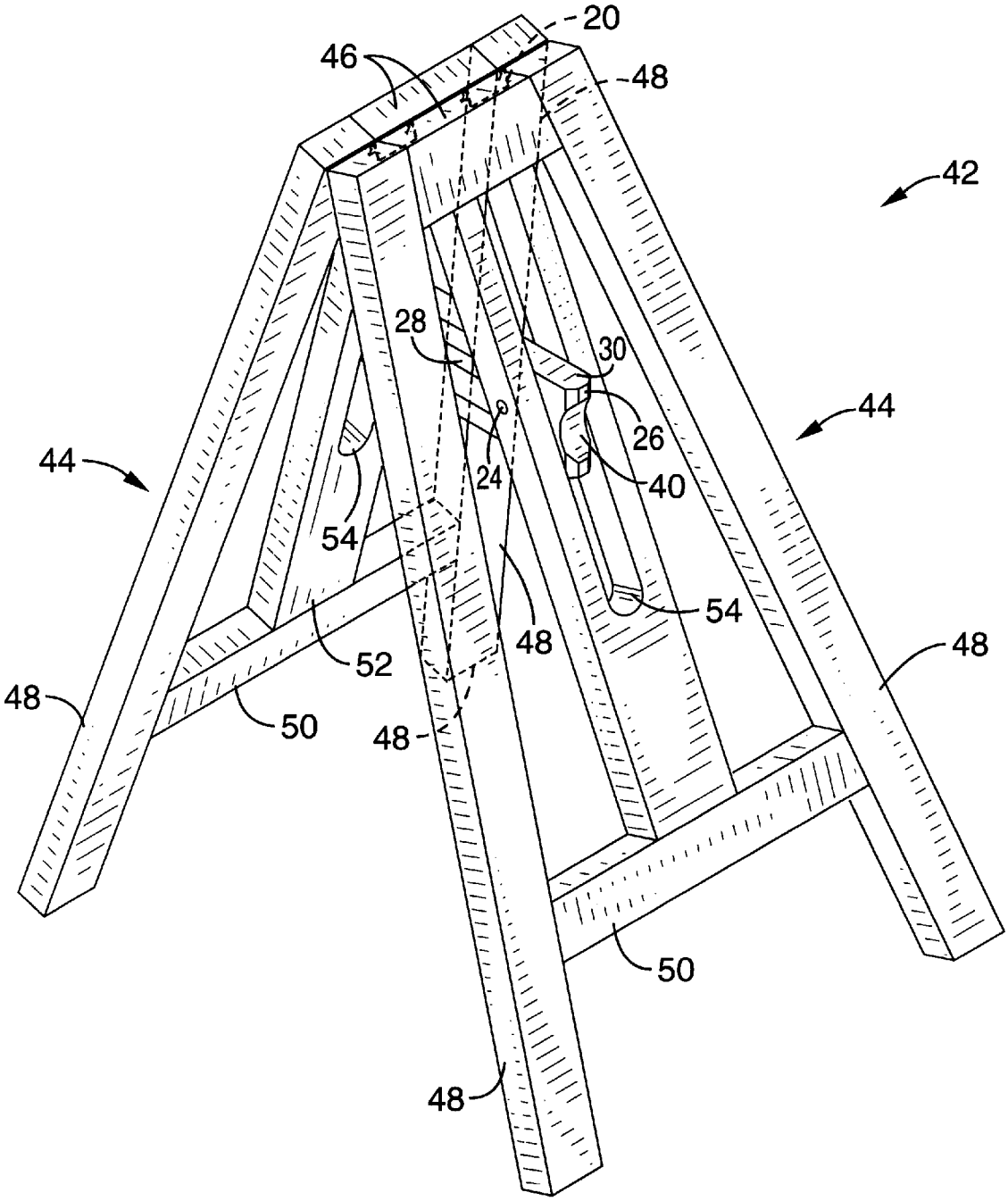
FIG. 6 is a perspective view of an alternative embodiment of the sawhorse of the invention.
Figure 7:
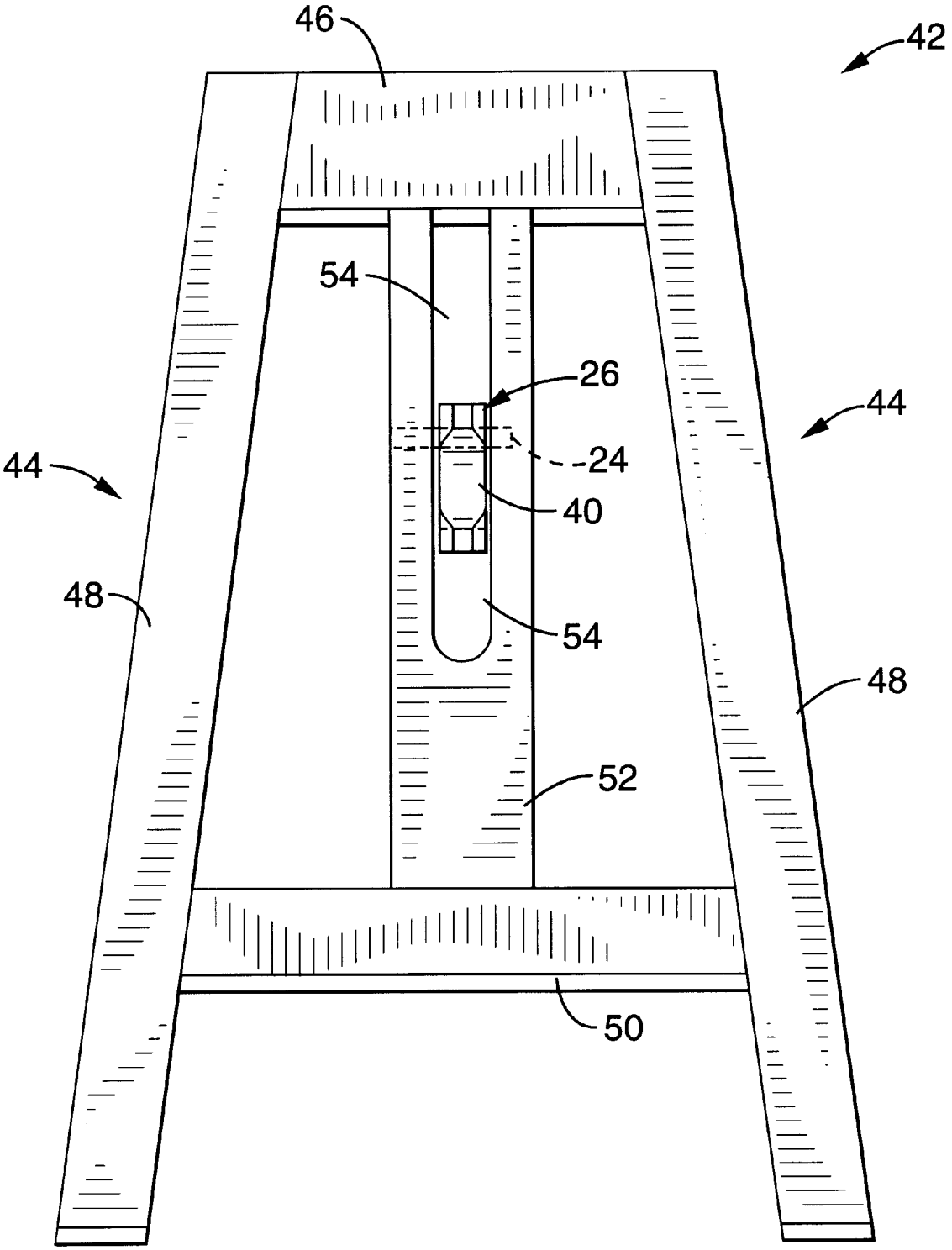
FIG. 7 is a side elevation view of the alternative sawhorse shown in FIG. 6.
Figure 8:
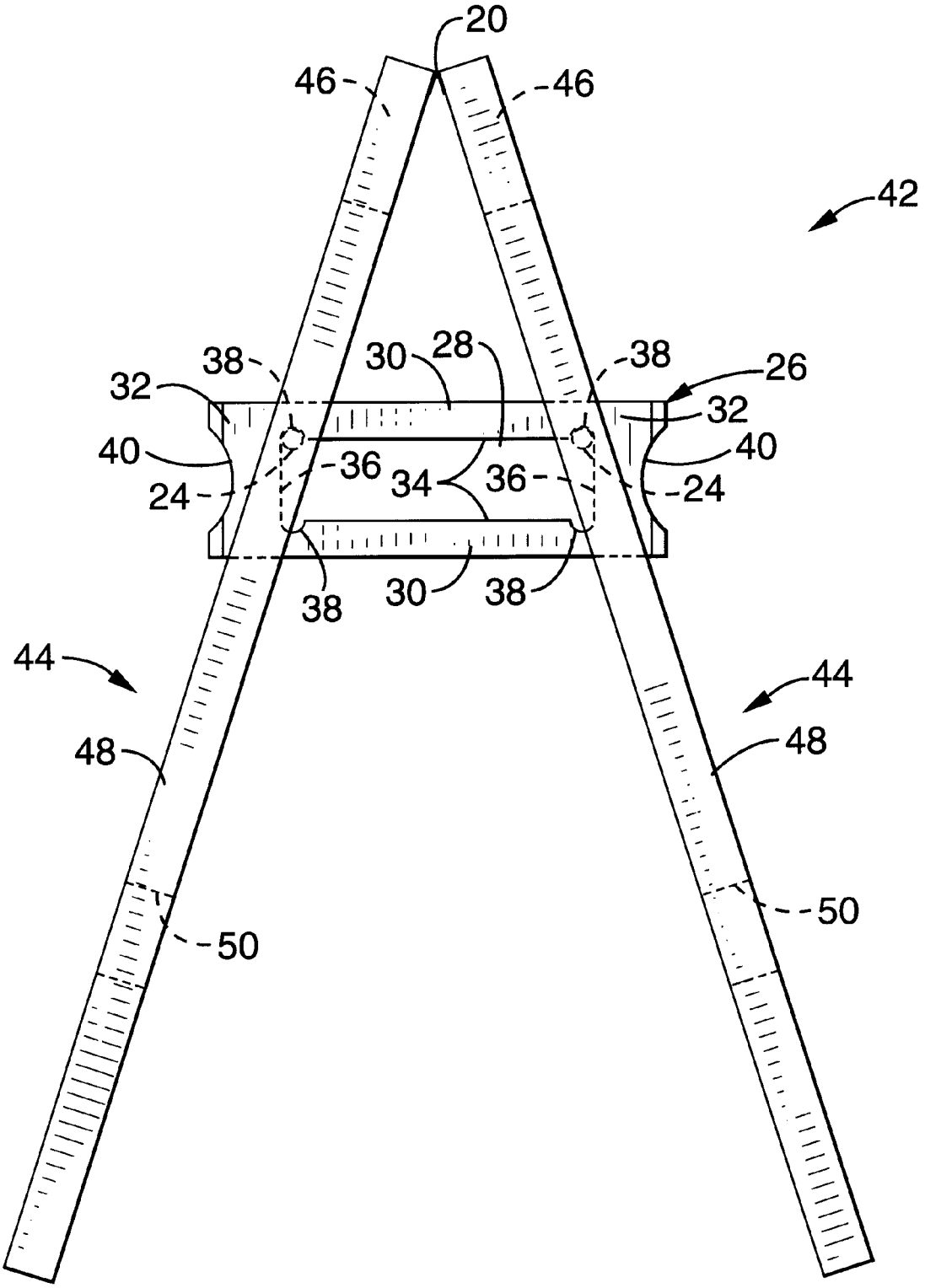
FIG. 8 is an end elevation view of the alternative sawhorse shown in FIG. 6.

An alternative embodiment of the inventive sawhorse illustrates the versatility of the concept disclosed herein. The alternative sawhorse is identified herein with reference numeral 42, and is shown is shown in FIGS. 6 through 9. FIG. 6 shows that alternative sawhorse 42 is comprised of a pair of identical frame members 44, each connected to the other by hinges 20 at their top beams 46. Each frame member 12 is comprised of horizontal top beam 46; an identical leg 48 affixed to and depending from each end of horizontal top beam 46; and, horizontal brace 50 between the lower ends of legs 48. Each frame member 44 of alternative sawhorse 42 is generally planar and is preferably an integral structure unto itself. However, instead of being generally rectangular, each frame member 44 is trapezoidal; the legs of each frame member diverge a bit outward from the opposed ends of top beam 46. This is best illustrated in FIG. 7.

Sawhorse 42 includes an intermediate structural member 52 in each of its frame members 44. Intermediate structural member 52 is an auxiliary brace; it is disposed in a generally vertical configuration, generally parallel to legs 48, bound at its upper end to top beam 46 and at its lower end to brace 50.

Instead of having slots in its legs, sawhorse 42 has slots 54 in its intermediate structural members 52. Slots 54 include pins 24 and engage strut 26 just as described above for sawhorse 10.

Figure 9:
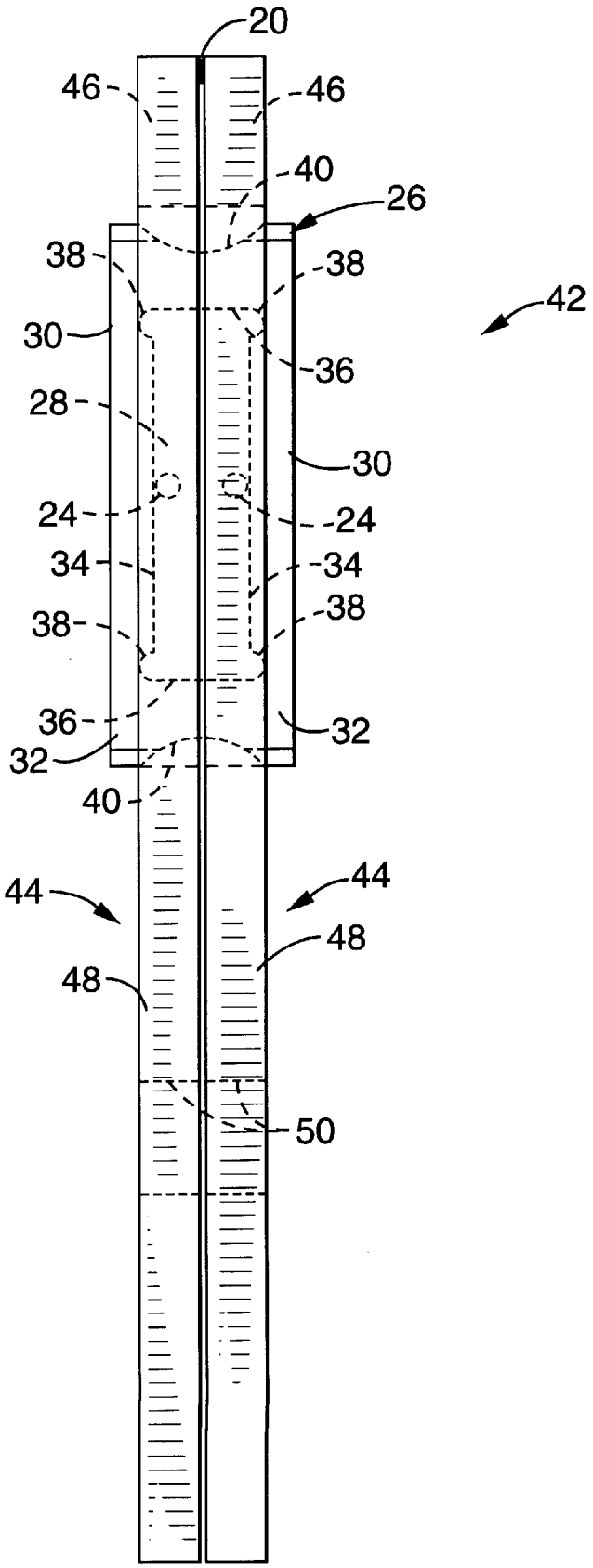
FIG. 9 is an end elevation view of the alternative sawhorse of FIG. 6, wherein the sawhorse is folded into its storage position.

In use of either sawhorse 10 or 42, when in a fully-closed position as shown in FIGS. 4 and 9, such sawhorses may be carried around, or leaned against a wall for storage, and strut 26, being in its upright position with pins 24 bound closely together between strut 26's side members 30, will resist falling open and taking up space, and becoming cumbersome to handle and transport.

Then, when it is desired to open sawhorse 10 or 42 into its supporting position, each strut 26 is merely pulled slightly from its nested orientation in slot 22 or 54, i.e. slightly away from the vertical, and then the frame members 12 or 44 are simply spread apart. Upon this action, struts 26 begin to fall from a generally vertical orientation toward a horizontal orientation. Once struts 26 are fully horizontal, and frame members 12 or 44 are spread apart to the maximum distance that pins 24 within the bound space 28 of struts 26 will allow, struts 26 end their travel in a horizontal position with pins 24 seated in the two detent notches 38 that reside in that side member 30 of strut 26 that happens to have ended up in the uppermost position. As each strut 26 is bilaterally symmetrical and also able to rotate a full 360 degrees through its respective pair of slots, a strut 26 may fall out of its slot in either direction and it will still end up seating with two detent notches 38 on pins 24. And, in a sawhorse such as sawhorse 10 having two struts 26, struts 26 may even drop out of their respective slots 22 in opposite directions and they will still end up horizontal and engaged with pins 24.

In practice, it has been found most convenient for the user to simply rest the folded-up inventive sawhorse 10 or 42 against his or her thighs, then to lean over it slightly and unseat each strut a bit from its slot. Then, all the user needs to do is to tilt the sawhorse a bit away from the thighs, letting the outermost frame member swing away and diverge from the closer frame. As the outermost frame reaches the extent of its travel, its struts drop into place, and it sets itself up almost automatically.

Once sawhorse 10 or 42 is set up, the rigid frame of strut 26 prevents frame members 12 or 44 from splaying any farther under weight atop its beam 14 or 46. More weight on the sawhorse causes better engagement of the strut. And, owing to pins 24 being seated in detent notches 38, strut 26 resists frame members 12 or 44 from being driven back together toward their closed position. This is important, for example, when the leg of a sawhorse is impacted; it prevents the sawhorse from folding up partially or completely at an inopportune time. It is also sometimes handy to have a sawhorse stay spread out in its supporting position while it is momentarily picked up and moved. Strut 26 provides that ability.

Thus, as can be appreciated from the foregoing, the novel slot, pin and strut combination holds the legs or frame members of a sawhorse together when the strut is in one orientation (vertical), but it holds the legs or frame members apart when it is in an alternative orientation (horizontal). In other words, when strut 26 is vertical it restricts the movement of the legs or frame members of the sawhorse to diverging a certain maximum distance, that maximum distance being minimal when strut 26 is vertical and the sawhorse is in its storage orientation. However, when strut 26 is horizontal, it restricts the movement of the legs or frame members of the sawhorse to diverging an alternative maximum distance, that selectively alternative maximum distance being greater than the maximum distance when strut 26 is vertical. And, when the legs or frames are fixed at the greater of the two alternative maximum distances, resistance is provided against returning the legs or frames toward each other.

The amount of resistance strut 26 can exert against frame members 12 or 44 being returned toward their folded position can be determined by making detent notches 38 shallower or deeper, or by making their transitions between side face 30's inner surface 34 and the interior of the notch more or less rounded. Deeper notches in a strut will make a more secure supporting structure, but will take some significant upward force to disengage such strut from its pins. In contrast, a strut with shallower or rounded-edged notches may be disengaged by simply pressing the two frames of the sawhorse toward each other.

Other alternative embodiments and hybrid structures are envisioned. For example, features of both sawhorses 10 and 42 could be combined in a three-legged support by using one frame member 44 from sawhorse 42 and an opposing single leg similar to one in sawhorse 10. Strut 26, in that case, would be engaged with slots similar to slot 54 of frame member 44 and slot 22 of a leg of frame member 12. A slightly taller, lighter-weight form of such a structure may serve well for use as an easel, or as a music stand or like structure. And, such leg, slot, pin and strut combinations could be employed for supporting table tops and other work surfaces, and many other types of articles.

It is also specifically noted that although great benefits are derived from use of the inventive strut in the environment of supporting apparatus having A-frame structures, other structures having generally vertical leg elements could be tied together with the inventive strut to yield beneficial results.

It is also envisioned that a strut having additional detent notches along its inside faces could provide additional benefits of adjustability.

It is further envisioned that a leg or other frame member having sufficient thickness may have a slot that is not cut all the way through the leg or member; in essence, such a slot would be a very deep groove. This could also be referred to as a blind slot. Nevertheless, a strut of the type described bound into this blind slot by a transverse pin would be able to function in a manner similar to that otherwise described herein; and, when stowed vertically, it would nest partially in that blind slot. Opposing legs or members both having such blind slots would conceal the existence of the strut when the members were close together in a collapsed position.

Finally, just as in the previously-known sawhorse kits discussed above, a kit for constructing a sawhorse based on the inventive combination is envisioned. Such a kit would include a pair of legs tied together with the inventive slot, pin and strut combination, and they would be mated with any of a number of different possible mechanisms, all within the skill in the art, for mating with a beam for horizontal support. Two such leg pairs, one at each end of a beam, would yield a sawhorse having the benefits of the invention. And, if the means used to attach a leg pair to a beam end is repeatedly engageable and disengageable, then this sawhorse kit can be broken down into even smaller elements than a dual-frame sawhorse for additional ease of transport and storage. Of course, for maximum stability, a user may wish to add permanent or removable leg braces parallel to the beam, after the kit described is assembled.

The foregoing detailed disclosures of the inventive collapsible, dual-frame, trestle-type sawhorses 10 and 42, and the repositionable strut used in their construction, are considered as only illustrative of the preferred embodiments of, and not limitations upon the scope of, the invention. Those skilled in the art will envision many other possible variations of the structures disclosed herein that nevertheless fall within the scope of the following claims. And, alternative uses for these inventive trestle and repositionable leg strut constructions may later be realized. Accordingly, the scope of the invention should be determined with reference to the appended claims, and not by the examples which have herein been given.

I claim:

1. Apparatus fixing a first object at a first maximum distance from a second object or, alternatively, at a second maximum distance from said second object, said apparatus comprising:

a. said first and second objects each having an elongate slot in a structural member integral with each object;

b. a transverse pin across each said slot;

c. a rigid, rectangular-framed strut, comprising two longer side members and two shorter end members, wherein said side members are shorter than each said slot, and wherein said side members and said end members are narrower than each said slot, said pins both passing through a single bound space within the rigid frame of said strut, said strut thereby being simultaneously slidingly captured in both said slots.

2. The apparatus of claim 1, further including a detent notch where an inner surface of each side member of said strut meets an inner surface of each end member of said strut, whereby when said first and second objects are at said first maximum distance from each other, a pin engages a detent notch thus creating resistance against movement of said objects to said second maximum distance from each other.

3. A support structure, comprising:

a. a first upstanding frame member;

b. an elongate slot in said first frame member;

c. a first horizontal pin, said first pin being disposed within and transverse to said first frame member's elongate slot;

d. a second upstanding frame member;

e. an elongate slot in said second frame member;

f. a second horizontal pin, said second pin being disposed within and transverse to said second frame member's elongate slot;

g. a rigid rectangular-framed strut, comprising two longer side members and two shorter end members, wherein said side members are shorter than each said slot, and wherein said side members and said end members are narrower than each said slot, said first and second pins each passing through a single bound space within the rigid frame of said strut, said strut thereby being simultaneously slidingly captured in both said slots.

4. The support structure of claim 3, further including a detent notch where an inner surface of a side member of said strut meets an inner surface of an end member of said strut.

5. The support structure of claim 3, wherein said detent notch is shaped as a portion of a circular arc, the axis of said detent notch's arc lying in the plane of an inner surface of said side member, and being perpendicular to the length of said side member.

6. The support structure of claim 5, wherein an inner surface of an end member of said strut meets an inner surface of said detent notch at a tangent to said detent notch's arc.

7. The support structure of claim 3, further including a detent notch where an inner surface of each said side member of said strut meets an inner surface of each said end member of said strut.

8. A sawhorse, comprising:

a. a first frame member having an upper, horizontal support beam;

b. an elongate slot in said first frame member, said slot including a transverse pin therein;

c. a second frame member having an upper, horizontal support beam;

d. an elongate slot in said second frame member, said slot including a transverse pin therein;

e. a hinge between said first and second frame members' upper horizontal support beams, wherein in operation of said hinge, the respective longitudinal axes of said support beams remain parallel; and, f. a strut comprising a closed, rigid frame, said strut having an inner surface with at least two pin-receiving notches therein, first and second ends of said strut residing in said first and second slots such that said pins of said slots pass though said strut's closed frame and bind said strut into said slots.

9. A pair of legs for use in constructing a sawhorse, comprising:

a. a first leg;

b. a second leg;

c. means for hingedly affixing an upper portion of said first leg to an upper portion of said second leg;

d. a longitudinal slot in said first leg, said slot including a transverse pin therein;

e. a longitudinal slot in said second leg, said slot including a transverse pin therein;

f. a rigid, closed-framed strut, narrower than each said slot, said first and second pins each passing through a single bound space within the rigid frame of said strut, said strut thereby being simultaneously slidingly captured in both said slots.

10. A sawhorse, comprising:

a. a first frame member comprising:

i. a horizontal support beam having first and second ends;

ii. a first leg depending from adjacent said first end of said support beam;

iii. a second leg depending from adjacent said second end of said support beam; and, iv. a leg brace between said first and second legs, spaced apart from said support beam b. an elongate slot in said first frame member;

c. a first horizontal pin, said first pin being disposed within and transverse to said first frame member's elongate slot;

d. a second frame member comprising:

i. a horizontal support beam having first and second ends;

ii. a first leg depending from adjacent said first end of said support beam;

iii. a second leg depending from adjacent said second end of said support beam; and, iv. a leg brace between said first and second legs, spaced apart from said support beam;

e. an elongate slot in said second frame member;

f. a second horizontal pin, said second pin being disposed within and transverse to said second frame member's elongate slot;

g. means for fixing said first and second horizontal support beams to one another such that their respective longitudinal axes remain parallel, while each said beam remains able to move with respect to the other; and, h. a rigid rectangular-framed strut, comprising two longer side members and two shorter end members, wherein said side members are shorter than each said slot, and wherein said side members and said end members are narrower than each said slot, said first and second pins each passing through a single bound space within the rigid frame of said strut, said strut thereby being simultaneously slidingly captured in both said slots.

11. The sawhorse of claim 10, wherein said first and second slots are in a leg of said first frame member and in a leg of said second frame member, respectively, and wherein said slotted legs are opposed.

12. The sawhorse of claim 10, said first frame member further including an auxiliary brace from said support beam to said leg brace, between and generally parallel to said first frame member's legs, said second frame member further including an auxiliary brace from its respective said support beam to its respective said leg brace, between and generally parallel to its respective said legs, wherein said first and second slots are in said first and second frame members' auxiliary braces, respectively.

13. The sawhorse of claim 10, wherein said first and second legs of said first frame member are parallel to one another, and wherein said first and second legs of said second frame member are parallel to one another.

14. The sawhorse of claim 10, wherein said first and second legs of said first frame member have upper and lower ends, and wherein said upper ends of said first frame member's legs are closer together than said lower ends of said legs.

15. The sawhorse of claim 10, wherein said means for fixing said support beams to one another comprises a hinge binding a side face of said first support beam to a side face of said second support beam.

* * * * *